US008801142B2

(12) United States Patent
Ohashi

(10) Patent No.: US 8,801,142 B2
(45) Date of Patent: Aug. 12, 2014

(54) METHOD FOR RECORDING GLITTER IMAGE

(71) Applicant: Seiko Epson Corporation, Tokyo (JP)

(72) Inventor: Masakazu Ohashi, Shiojiri (JP)

(73) Assignee: Seiko Epson Corporation (JP)

( * ) Notice: Subject to any disclaimer, the term of this patent is extended or adjusted under 35 U.S.C. 154(b) by 47 days.

(21) Appl. No.: 13/628,409

(22) Filed: Sep. 27, 2012

(65) Prior Publication Data

US 2013/0083118 A1 Apr. 4, 2013

(30) Foreign Application Priority Data

Sep. 30, 2011 (JP) ..... 2011-216165

(51) Int. Cl.
*B41J 2/015* (2006.01)

(52) U.S. Cl.
USPC ..... 347/20

(58) Field of Classification Search
USPC ..... 347/2, 20, 100, 101, 102, 106
See application file for complete search history.

(56) References Cited

U.S. PATENT DOCUMENTS

| | | | | |
|---|---|---|---|---|
| 5,312,645 | A * | 5/1994 | Dressler | 347/100 |
| 2008/0145628 | A1 | 6/2008 | Oyanagi et al. | |
| 2012/0081485 | A1* | 4/2012 | Ohashi | 347/103 |
| 2012/0113171 | A1* | 5/2012 | Murata | 347/2 |

FOREIGN PATENT DOCUMENTS

| | | |
|---|---|---|
| JP | 2001-310597 | 11/2001 |
| JP | 2002-154724 | 5/2002 |
| JP | 2008-174712 | 7/2008 |
| JP | 2009-226863 | 10/2009 |

* cited by examiner

*Primary Examiner* — Kristal Feggins
(74) *Attorney, Agent, or Firm* — Harness, Dickey & Pierce, P.L.C.

(57) ABSTRACT

A method for recording a glitter image includes attaching an ink composition to a recording medium using an ink jet method, attaching an adhesive composition to the ink composition which is attached to the recording medium using an ink jet method, bringing a sheet where a glitter film is formed into contact with the recording medium so that a surface where the adhesive composition is attached and a surface where the glitter film is formed are opposed, heating the adhesive composition, and peeling off the recording medium and the sheet.

16 Claims, 4 Drawing Sheets

METHOD FOR RECORDING GLITTER IMAGE

Priority is claimed under 35 U.S.C. §119 to Japanese Application No. 2011-216165 filed on Sep. 30, 2011, which is hereby incorporated by reference in its entirety.

BACKGROUND

1. Technical Field

The present invention relates to a method for recording a glitter image.

2. Related Art

In recent years, demand for recordings where an image which has glossiness is formed on a recording surface is increasing. As a method for forming images which has glossiness, in the related art, for example, there are a foil pressing recording method in which a recording medium which has a recording surface with high planarity is prepared and a metal foil is pressed onto the recording medium, a method in which a metal or the like is vacuum deposited with regard to a plastic film where the recording surface is smooth, a method in which glitter pigment ink is coated onto a recording medium and press processing is further performed, and the like.

In addition, there is a method where an image is formed by ink which has a glitter pigment (hereinafter, referred to as glitter ink) being discharged using an ink jet method (for example, refer to JP-A-2008-174712). In the glitter ink, a resin is included, bonding of the image which has been formed is improved with regard to the recording medium and an improvement in scratch resistance is expected.

However, different from the coloring of color ink, the glossiness of glitter ink is developed by the smooth arrangement of the glitter pigment on the surface after recording. As a result, when a considerable amount of resin was added in order that scratch resistance is more superior in a case where a glitter image is formed using glitter ink, there was a problem in that the arrangement was impaired and the glossiness was reduced.

On the other hand, in order to obtain the smoothness of the surface of the glitter image, a method is considered where an image with superior glitter is obtained by transferring a deposited film with glossiness, which is formed so as to have a smooth surface in advance on a film or the like, to a recording medium. In the method, for example, an adhesive agent is adhered on the recording medium and the adhesive agent comes into contact with the deposited film so that the deposited film is transferred to the recording medium from the film.

However, in the method, there are cases where a defect, where the scratch resistance of the glitter image is insufficient due to the bonding of the adhesive agent which is used for transferring and the recording medium being insufficient, and a defect, where it is not possible for the adhesive agent to be brought into contact with the deposited film due to having soaked into the recording medium, are generated.

SUMMARY

An advantage of some aspects of the invention is to provide a method for recording a glitter image where it is possible to easily form an image with excellent glossiness and adhesion with regard to the recording medium.

The invention can be realized in the following forms or application examples.

APPLICATION EXAMPLE 1

According to the Application Example 1, there is provided a method for recording a glitter image including attaching an ink composition to a recording medium using an ink jet method, attaching an adhesive composition to the ink composition which is attached to the recording medium using an ink jet method, bringing a sheet where a glitter film is formed into contact with the recording medium so that a surface where the adhesive composition is attached and a surface where the glitter film is formed are opposed, heating the adhesive composition, and peeling off the recording medium and the sheet.

According to the recording method of the Application Example, it is possible to easily form an image with excellent glossiness and bonding with regard to the recording medium.

APPLICATION EXAMPLE 2

In the Application Example 1, the recording medium may have ink absorbability and the ink composition may contain a pigment.

According to the Application Example, it is possible to suppress the penetration of the adhesive composition to the recording medium since it is easy to close off holes in the surface of the recording medium using the ink composition. As a result, according to the Application Example, it is possible to easily form an image with excellent glossiness and bonding with regard to the recording medium which has ink absorbability.

APPLICATION EXAMPLE 3

In the Application Example 2, the pigment may be a white pigment.

According to the Application Example, it is possible to suppress the penetration of the adhesive composition to the recording medium since it is easier to close off holes in the surface of the recording medium using the ink composition. As a result, according to the Application Example, it is possible to easily form an image with excellent glossiness and bonding with regard to the recording medium which has ink absorbability.

APPLICATION EXAMPLE 4

In the Application Example 3, the volume-based average particle diameter of the white pigment may be 300 nm or more.

According to the Application Example, it is possible to suppress the penetration of the adhesive composition to the recording medium since it is easier to close off holes in the surface of the recording medium using the ink composition. As a result, according to the Application Example, it is possible to easily form an image with excellent glossiness and bonding with regard to the recording medium which has ink absorbability.

APPLICATION EXAMPLE 5

In the Application Example 1, the recording medium may not have ink absorbability in practice and the ink composition may contain a white pigment.

According to the Application Example, it is possible to form a white recording layer on a foundation of the glitter image which is recorded onto the recording medium. As a result, according to the Application Example, it is possible to easily form an image with excellent glossiness and bonding with regard to the recording medium which does not have ink absorbability in practice.

Here, the "recording medium which does not have ink absorbability in practice" in the specifications indicates a "recording medium where the water absorption rate from the start of contact to 30 $msec^{1/2}$ in the Bristow method is 10 $mL/m^2$ or less".

APPLICATION EXAMPLE 6

In the Application Example 1, the recording medium may not have ink absorbability in practice and the ink composition may not contain a pigment in practice.

According to the Application Example, it is possible to easily form an image with excellent glossiness and bonding with regard to the recording medium which does not have ink absorbability in practice.

The sentence of "the ink does not contain a specific component in practice" in the specifications indicates a case where an amount, where the meaning where the specific component is contained is sufficiently exhibited, is not intentionally contained, and for example, the amount of the specific component contained in the ink is less than 0.05 mass %, more preferably is less than 0.01 mass %, is even more preferably less than 0.005 mass %, and is most preferably less than 0.001 mass %.

APPLICATION EXAMPLE 7

In any one example out of the Application Example 1 to the Application Example 6, the ink composition may contain a resin of 3 mass % or more.

According to the recording method of the Application Example, it is possible to easily form an image with further excellence in bonding with regard to the recording medium.

APPLICATION EXAMPLE 8

In any one example out of the Application Example 1 to the Application Example 7, the adhesive composition may contain an adhesive compound and the adhesive compound may have a Tg which is −10° C. or more and 70° C. or less.

According to the recording method of the Application Example, it is possible to easily form an image with further excellence in glossiness and bonding with regard to the recording medium.

APPLICATION EXAMPLE 9

In any one example out of the Application Example 1 to the Application Example 8, drying may be further provided between the attaching of the ink composition and the attaching of the adhesive composition and the mass of the ink composition which is attached to the recording medium may be reduced by 40% or more and 95% or less in the drying.

According to the recording method of the Application Example, it is possible to easily form an image with further excellence in glossiness and bonding with regard to the recording medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
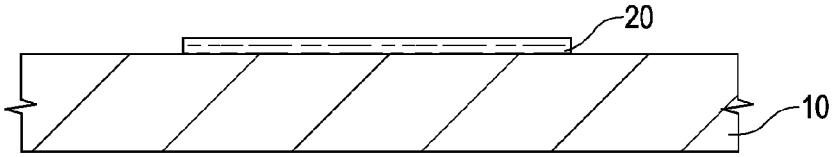
FIG. 1 is a schematic diagram of a process of a recording method of an embodiment.

Several embodiments of the invention will be described below. The embodiments which are described above describe examples of the invention. The invention is not limited to any of the embodiments below and includes various modifications which are executed in the scope which does not depart from the gist of the invention. Here, the entirety of the configuration which is described in the embodiments below is not necessary constituent elements of the invention.

1. Method for Recording a Glitter Image 1.1. Description of Terminology 1.1.1. Glitter Image A glitter image which is recorded using a recording method of the embodiment has glossiness. It is possible for the glossiness to be evaluated using, for example, specular glossiness of an image (refer to Japanese Industrial Standard (JIS) Z8741). For example, in an image which is formed with ink which contains a metal pigment, the specular glossiness which is measured is high and it is possible to evaluate an image with high glossiness in a case where the surface is planar. In addition, for example, in an image which is formed with ink which contains a metal pigment, the specular glossiness which is measured is small in a case where the surface is rough and becomes a so-called mat image, but it is possible to evaluate the glossiness by measuring the specular glossiness even in such a case.

1.1.2. Ink Jet Method

An ink jet method indicates a recording method using an ink jet recording method, and for example, indicates a method (electrostatic attraction method) where a strong electric field is applied between a nozzle and an acceleration electrode which is placed in front of the nozzle, ink is continuously ejected from the nozzle in the form of liquid droplets, and printing information signal is recorded by being applied polarization electrodes while the ink droplets are flying between the polarization electrodes or the ink droplets are ejected to correspond to the printing information signal without the ink droplets being polarized, a method where ink droplets are forcibly discharged by a pressure being applied to the ink droplets using a small pump and a nozzle being mechanically vibrated using a quartz oscillator or the like, a method (piezo method) where a pressure and a printing information signal are added at the same time to ink droplets using a piezoelectric element and the ink droplets are ejected and recorded, a method (thermal jet method) where ink droplets are heated and formed into bubbles using a small electrode according to the printing information signal and the ink droplets are ejected and recorded, and the like.

It is possible for the ink jet method which is used in the recording method of the embodiment to be performed using an ink jet recording apparatus which is provided with an ink jet recording head, a body, a tray, a head driving mechanism, a carriage, and the like. Here, the ink jet recording head is provided with an ink cartridge which accommodates an ink set with at least four colors of, for example, cyan, magenta, yellow, and black and may be configured so that full color printing is possible. In addition, in the embodiment, an ink composition and an adhesive agent which will be described later may be filled into and provided in at least one of the ink cartridges. In addition, normal ink or the like may be filled in to cartridges other than these cartridges. The ink jet recording apparatus is internally provided with a dedicated control board and the like and it is possible to control the discharge timing of the ink of the ink jet recording head, the scanning of the head driving mechanism, the movement of the recording medium, and the like.

In the ink jet method, since it is possible to easily form a desired image with a comparatively small scale device configuration where it is not necessary to prepare a plate or the like, it is possible to suppress wastefulness of the ink composition and the adhesive composition.

1.1.3. Recording Medium

A recording medium 10 which is used in the recording method of the embodiment is not particularly limited. As the recording medium 10, for example, examples include various types of paper, cloth, films, sheets, and the like. More specifically, examples include types of paper which are disclosed in the Japanese Industrial Standard JIS-P0001, types of cloth which are disclosed in JIS-L0206, types of nonwoven cloth which are disclosed in JIS-L0222, types of films with materials such as polyethylene terephthalate (PET), polybutylene terephthalate (PBT), polycarbonate, polyethylene naphthalate, polyester, polyethylene, polypropylene, acrylic resin, polystyrene, polyvinyl chloride, polyvinyl acetate, polyvinyl alcohol, polyether ether ketone, polyamide, polyether sulfone, polydiacetate, triacetate, polyimide, wood, metal, ceramics, glass, and types of sheets. In addition, as the recording medium 10, coated paper such as coating paper and art paper may be used.

As commercially available products of the recording medium 10, there are Pearl Coat Paper (manufactured by Mitsubishi Paper Mills Limited), Aurora Coat Paper (manufactured by Nippon Paper Industries Co., Ltd.), Photo Crispia (manufactured by Seiko Epson Corporation), Photo <Gloss> (manufactured by Seiko Epson Corporation), Photo Entry (manufactured by Seiko Epson Corporation), Photo Gloss Paper (manufactured by Seiko Epson Corporation), and the like.

It is possible to classify the recording medium 10 which is exemplified above into those where ink is absorbed and those where ink is hardly absorbed or not absorbed at all depending on the surface characteristics. In the specifications, the latter is referred to the "recording medium which does not have ink absorbability in practice". Here, it is possible for the absorption of the ink in the recording medium 10 to be evaluated using the Bristow method. Then, the "recording medium which does not have ink absorbability in practice" indicates a "recording medium where the amount of the water absorption from the start of contact to 30 $msec^{1/2}$ in the Bristow method is 10 $mL/m^2$ or less".

The Bristow method is a method which is most wide spread as a method for measuring the amount of liquid absorption in a short period of time and is adopted by Japan Technical Association of the Pulp and Paper (JAPAN TAPPI). The details of the testing method are described in "Bristow Method—Testing Method for Liquid Absorption in Paper and Cardboard" in specification no. 51 in "Pulp and Paper Testing Methods of Japan Technical Association of the Pulp and Paper 2000 edition".

1.1.4. Ink Composition

The ink composition which is attached with regard to the recording medium 10 using an ink jet method may be an ink composition which contains a pigment or an ink composition which does not contain a pigment. The ink composition which does not contain a pigment is equivalent to an ink where the pigment has been removed from an ink composition which contains a pigment and there are cases where the ink is referred to as dye ink or clear ink. The composition of the ink composition is not particularly limited, but it is possible to contain a surfactant, a multivalent alcohol, an organic solvent, and a resin component. In addition, the ink composition may be water-based or may be solvent-based (non-water based). In addition, in a case where the ink composition contains a pigment, the ink composition may further have a dispersing agent or the like mixed in.

1.1.4.1. Water

The ink composition of the embodiment may be a water-based ink composition which contains water to be 50 mass % or more or may be a non-water-based ink composition where the content of water is less than 50 mass %. As water which is able to be used in the ink composition, there are, for example, pure water or ultrapure water such as ion-exchange water, ultrafiltered water, reverse osmosis water, or distilled water. In addition, ions or the like may be present in the water. In particular, it is preferable since it is possible for water, which has been treated by sterilization by carrying out ultraviolet irradiation on the water, the addition of hydrogen peroxide or the like, to suppress the generation of mold and bacteria over a long period of time and it is possible to stably maintain the ink composition for a long period of time.

In a case where water is contained in the ink composition of the embodiment, the content of the water is, for example, preferably 20 mass % or more and 95 mass % or less with regard to the total amount of the ink composition.

Here, that the content of the water is 20 mass % or more and 95 mass % or less indicates that the content of the components other than water is 5 mass % or more and 80 mass % or less. In the specifications, there are cases where the component other than water is referred to as solid content and that the content of the water is 20 mass % or more and 95 mass % or less indicates that the solid content in the ink composition is 5 mass % or more and 80 mass % or less.

In a case where water is contained in the ink composition, the water may function as a dispersing agent which disperses the pigment. In addition, due to the water being contained in the ink composition, it is possible to prevent unwanted drying (evaporation of the dispersing agent) in the ink composition in the vicinity of the nozzle of the ink jet recording apparatus and to perform swift drying on the recording medium where ink has been imparted. In addition, the water-based ink composition has an advantage in that the burden on the environment is small.

1.1.4.2. Surfactant

The ink composition of the embodiment may contain a surfactant. As an appropriate surfactant for the ink composition of the embodiment, examples include at least one type of an acetylene glycol-based surfactant and a polysiloxane-based surfactant. When the surfactant is mixed into the ink composition, it is possible to increase the wetting of the surface of the recording medium where recording is carried out.

As the acetylene glycol-based surfactant, for example, examples include 2,4,7,9-tetramethyl-5-decyne-4,7-diol, 3,6-dimethyl-4-octyne-3,6-diol, 3,5-dimethyl-1-hexyne-3-ol, 2,4-dimethyl-5-hexyne-3-ol, and the like. In addition, it is possible to use commercially available products as the acetylene glycol-based surfactant, and for example, examples includes Olefin E 1010, STG, Y, Surfynol 104, 82, 465, 485, TG, DF110-D (the above manufactured by Nissin Chemical Industry Co., Ltd.). It is possible to use commercially available products as the polysiloxane-based surfactant, for example, examples include BYK-347 and BYK-348 (manufactured by BYK Japan KK) and the like. Furthermore, another surfactant such as an anionic surfactant, a nonionic surfactant, or an ampholytic surfactant may be added in the ink composition of the embodiment.

In a case where the surfactant is contained in the ink composition of the embodiment, the content of the surfactant is preferably 0.01 mass % or more and 5 mass % or less and is more preferably 0.1 mass % or more and 3 mass % or less with regard to the total content of the ink composition.

1.1.4.3. Multivalent Alcohol

The ink composition of the embodiment may contain a multivalent alcohol.

As the multivalent alcohol, for example, examples include an alkane diol with 4 or more and 8 or less carbon atoms such as ethylene glycol, diethylene glycol, triethylene glycol, polyethylene glycol, polypropylene glycol, 1,2- or 1,3-propylene glycol, 1,2- or 1,4-butylene glycol, (1,2-butanediol or 1,4-butanediol), 1,2-pentanediol, 1,2-hexanediol, 1,6-hexylene glycol, 1,2-heptane diol, 1,2-octane diol, 2-butene-1,4-diol, 2-methyl-2,4-pentanediol, mono-, oligo-, or poly-alkylene glycols which have $C_2$ to $C_6$ alkylene units such as diethylene glycol, triethylene glycol, tetraethylene glycol, dipropylene glycol, polyethylene glycol, polypropylene glycol, and compounds which have a plurality of thiol or hydroxyl groups such as 1,2,6-hexane triol, thioglycol, hexylene glycol, glycerin, trimethylol ethane, and trimethylol propane.

As one function of the multivalent alcohol, it is possible to exemplify increasing of the penetration of the ink by increasing the wetting of the recording surface of the recording medium. In addition, in a case where the ink composition is applied to the ink jet recording apparatus, there are cases where the alkane diol which has been exemplified has the effect of preventing the drying of the ink composition and preventing clogging in the ink jet recording head portion.

In addition, out of the multivalent alcohols, 1,2-alkanediol with 4 to 8 carbon atoms such as 1,2-butanediol, 1,2-pentanediol, 1,2-hexanediol, 1,2-heptanediol, and 1,2-octanediol is more preferable since there is further excellence in the action of increasing the penetration into the recording medium of the ink composition. Furthermore, out of these, 1,2-hexanediol, 1,2-heptanediol, and 1,2-octanediol with 6 to 8 carbon atoms are more preferable since the action of increasing the penetration into the recording medium of the ink composition is particularly excellent.

In a case where the multivalent alcohol is contained in the ink composition of the embodiment, the content of the multivalent alcohol is preferably 0.1 mass % or more and 10 mass % or less and is more preferably 1 mass % or more and 8 mass % or less with regard to the total content of the ink composition.

It is possible for the multivalent alcohol to have a plurality of functions by being used singly or as a combination, and it is possible for a function of suppressing the drying of the ink to be exemplified as another function which is a function which improves penetration as described above, and it is possible to increase the effect of preventing clogging of ink in the ink jet recording head portion in a case where the ink composition is applied to the ink jet recording apparatus. Furthermore, since the effect of suppressing the drying of the ink composition by increasing the function of supplementing moisture is increased, the multivalent alcohol, which is a compound where the number of hydroxyl groups in one molecule is higher with regard to the size of a hydrophobic region, may be appropriately selected as necessary.

1.1.4.4. Organic Solvent

The organic solvent may be contained in the ink composition.

As the organic solvent, examples include water-soluble organic solvents. If the organic solvent is a water-soluble organic solvent, it is possible for the discharge stability of the ink composition to be improved and the viscosity to be easily changed without significantly changing the characteristics of the ink composition. As specific examples of the organic solvent, examples include $C_1$ to $C_4$ alcohols such as methanol, ethanol, n-propanol, isopropanol, n-butanol, isobutanol, secondary butanol, and tertiary butanol; amides such as N,N-dimethylformamide and N,N-dimethylacetamide; heterocyclic ketones such as 2-pyrrolidone, N-methyl-2-pyrrolidone, hydroxyethyl-2-pyrrolidone, 1,3-dimethyl imidazolydin-2-one, and 1,3-dimethyl hexahydropyrimido-2-one; ketones or keto alcohols such as acetone, methyl ethyl ketone, 2-methyl-2-hydroxypentane-4-one, and acetonylacetone; cyclic ethers such as tetrahydrofuran and dioxane; glycol ethers ($C_1$ to $C_4$ mono-alkyl ether which is a multivalent alcohol) such as ethylene glycol monomethyl ether, ethylene glycol monobutyl ether, diethylene glycol monomethyl ether, diethylene glycol monoethyl ether, diethylene glycol monobutyl ether (butyl carbitol), triethylene glycol monomethyl ether, triethylene glycol monoethyl ether, propylene glycol monomethyl ether, dipropylene glycol monomethyl ether, dipropylene glycol monoethyl ether, propylene glycol monobutyl ether, dipropylene glycol monobutyl ether, and triethylene glycol monobutyl ether; esters such as γ-butyrolactone and triethyl phosphate; a furfuryl alcohol; a tetrahydrofurfuryl alcohol; thiodiglycol; trimethylglycine; dimethyl sulfoxide; and the like.

Here, solid substances are also contained in the organic solvent which is exemplified such as, for example, trimethylol propane and trimethyl glycine at room temperature. However, it is possible for water solubility to be expressed even if the substance or the like is a solid and furthermore the aqueous solution which includes the substance or the like to be used so that the effects of the water-soluble organic solvent are expected.

In addition, out of the organic solvents which are exemplified above, glycol ethers have a large effect as a penetration promotion agent, and when arranged in the ink composition, it is possible to increase the penetration of the ink composition into the recording medium, and in a case where color recording is performed, bleeding between adjacent inks on the recording medium is reduced and it is possible to obtain a sharper image.

Furthermore, out of the organic solvents which are exemplified above, for example, since the evaporation pressure of multivalent alcohols, ketones, esters, furfuryl alcohols, tetrahydrofurfuryl alcohol, thiodiglycol, and trimethylglycine is smaller than that of pure water or volatility is smaller by being a solid at room temperature, a moisturizing effect is high. As a result, these organic solvents have a large effect as a moisturizing agent, and when arranged in the ink composition, it is possible to expect an effect of suppressing evaporation of the moisture from the ink composition.

Here, other than the organic solvent which are exemplified above, it is possible to exemplify sugars such as maltitol, sorbitol, gluconolactone, and maltose as the moisturizing agent and it is also possible to appropriately use these sugars in the ink composition.

In addition, here, there are overlapping compounds in the compounds which are exemplified as an organic solvent in this section and the compounds which are exemplified as the multivalent alcohol in the previous section, and it is possible for such a compound to provide both functions as the organic solvent and the multivalent alcohol.

In a case where the organic solvent is contained in the ink composition, the content of the total of the organic solvent and the multivalent alcohol is preferably 1 mass % or more and 80 mass % or less with regard to the total amount of the ink composition and is more preferably, for example, 2 mass % or more and 50 mass % or less if viscosity of the ink composition, moisturizing, penetration into the recording medium, bleeding, and the like are considered.

1.1.4.5. Resin Component

The ink composition of the embodiment may contain a resin component. Due to the resin component being contained, it is possible to improve fixability and scratch resistance of the composition which is adhered. As the resin component, examples include but are not limited to a polyacrylate, a polymethacrylate, a polymethacrylate ester, a polyethyl acrylate, a styrene-butadiene copolymer, a polybutadiene, an acrylonitrile-butadiene copolymer, a chloroprene copolymer, a fluorine resin, a vinylidene fluoride, a polyolefin resin, cellulose, a styrene-acrylate copolymer, a styrene-methacrylic acid copolymer, a polystyrene, a styrene-acrylamide copolymer, a polyisobutyl acrylate, a polyacrylonitrile, a polyvinyl acetate, a polyvinyl acetal, a polyamide, a rosin-based resin, a polyethylene, a polycarbonate, a polyvinylidene chloride resin, a cellulose-based resin such as cellulose acetate butyrate, a polyvinyl acetate resin, an ethylene-vinyl acetate copolymer, a vinyl acetate-acrylic copolymer, a vinyl chloride resin, a polyurethane, a rosin ester, and the like. In addition, the resin component may be contained in the ink composition in a solution state or may be contained in a state of being an emulsion (particle dispersion body).

In a case where the resin component is used as a particle dispersion body, the volume-based average particle diameter of the resin particles is not particularly limited, but is preferably 20 nm or more and 300 nm or less. Due to this, when the ink composition is coated on the recording medium 10, it is possible to form a layer where the particles of the resin are concentrated on the surface. As a result, it is possible to expect an effect of contributing to excellent glossiness and sheen in the image which has been formed and an effect of suppressing the penetration of the adhesive composition to the recording medium 10.

In a case where the resin component is contained in the ink composition, the content thereof is preferably 1 mass % or more and 10 mass % or less with regard to the total amount of the ink composition and is more preferably 2 mass % or more and 8 mass % or less from the point of view of increasing the bonding of the recording medium and the glitter image.

1.1.4.6. Colorant

A colorant may be contained in the ink composition as necessary. Due to the colorant being contained in the ink composition, there are cases where it is possible to change the coloring in the glitter image.

As the colorant which is contained in the ink composition, examples include dyes and pigments and it is possible to use a colorant which is normally able to be used in an ink without any particular limitation.

As a dye which is able to be used in the ink composition, it is possible to use various types of dyes which are normally used in ink jet recording such as direct dyes, acid dyes, food dyes, basic dyes, reactive dyes, disperse dyes, vat dyes, soluble vat dyes, and reactive disperse dyes.

As a pigment which is able to be used in the ink composition, it is possible to exemplify an inorganic pigment and an organic pigment.

As the inorganic pigment, for example, it is possible to exemplify carbon black. In addition, as the organic pigment, for example, it is possible to use an azo pigment, a polycyclic pigment, a dye chelate, a nitro pigment, a nitroso pigment, aniline black or the like. As the color of the pigment, examples include black, yellow, magenta, cyan, and the like.

In a case where the colorant is contained in the ink composition of the embodiment, a plurality of the colorants may be contained. For example, in addition to the four basic colors of yellow, magenta, cyan, and black, a dark color and a light color in the same series for each color may be used in combination. That is, it is possible to exemplify that a light color of light magenta and a dark red are contained in addition to magenta, a light color of light cyan and a dark blue are contained in addition to cyan, grey and light black which are light colors and mat black which is a dark color to be contained in addition to black.

In addition, a white pigment may be used in the ink composition of the embodiment. As a white pigment which is able to be used in the ink composition, it is possible for examples to include oxides of elements in group IV in the periodic table such as titanium dioxide and zirconium dioxide. Other than this, as the white pigment, examples include calcium carbonate, calcium sulfate, zinc oxide, barium sulfate, barium carbonate, silica, alumina (aluminum oxide), kaolin, clay (clay mineral), talc, white clay, aluminum hydroxide, magnesium carbonate, magnesium oxide and the like and preferably, one type or a mixture of two or more types which are selected from the group formed of the white pigments above may be used.

In addition, in a case where a pigment is contained in the ink composition, furthermore, a pigment dispersing agent for dispersing the pigment may be added. As a preferably dispersing agent, it is possible to use a dispersing agent which is common in the preparing of a pigment dispersion solution, for example, a polymer dispersing agent. As such a dispersing agent, it is possible to use an arbitrary dispersing agent which is normally used in ink. The content in a case where the pigment dispersing agent is contained in the ink composition is preferably 5 to 200 mass % and is more preferably 30 to 120 mass % with regard to the content of the pigment in the ink composition and may be appropriately selected according to the colorant which is to be dispersed.

In addition, in the dispersing of the pigment in the dispersing agent, there are a plurality of methods such as resin dispersion, self-dispersion, microcapsule dispersion and the pigment may be dispersed in the ink composition of the embodiment using any of the methods.

When the pigment is contained in the ink composition of the embodiment, the volume-based average particle diameter of the pigment is preferably in the range of 10 nm or more and 500 nm or less, and more preferably is approximately 50 nm or more and 500 nm or less.

Here, it is possible to measure the volume-based average particle diameter of the pigment by determining the grain size accumulation curve or the like using, for example, a light (laser) scattering method, a nitrogen adsorption method, or the like.

In addition, in a case where the recording medium 10 which is adhered with the ink composition has ink absorbability, it is more preferable that the pigment is contained in the ink composition. When the ink composition which contains the pigment is adhered to the recording medium which has ink absorbability, it is easy for the pigment to close off concave sections in the surface of the recording medium and it is possible to obtain an effect of suppressing the adhesive composition which is adhered afterward being absorbed into the recording medium. In this case, the volume-based average particle diameter of the pigment is more preferably 300 nm or more due to the point that it is easy for the concave sections in the surface of the recording medium to be closed off.

In a case where the colorant is contained in the ink composition which is used in the embodiment, the amount of the colorant added is preferably in the range of 0.1 mass % or more and 25 mass % or less and is more preferably in a range of 0.5 mass % or more and 15 mass % or less.

1.1.4.7. Other Components

The ink composition of the embodiment may contain additives such as a fixing agent such as water-soluble rosin, a preservative/fungicide such as sodium benzoate, an antioxidant such as allophanates, a wetting agent, an ultraviolet absorber, a chelating agent, an oxygen absorbing agent, a penetration solvent, a pH adjusting agent, a fungicide, an antimold agent, a urea based compound, a drying inhibitor such as alkanolamine (triethanolamine or the like), thiourea, or the like as other components. It is possible for the additives to be used as one type singly or two or more types to be used in combination.

Furthermore, as necessary, a leveling additive, a matting agent, a polyester-based resin for adjusting the film properties of the image which is formed, a polyurethane-based resin, a vinyl-based resin, an acrylic-based resin, a rubber-based resin, or waxs may be contained in the ink composition. In addition, it is more preferable that the pigment be not redispersed in the ink composition when having come into with the adhesive composition. For example, due to a polyester-based resin, a polyurethane-based resin, a vinyl-based resin, an acrylic-based resin, a rubber-based resin, or waxs being contained, there are cases where it is possible to obtain an effect where redispersion is difficult.

1.1.4.8. Characteristics of Ink Composition

The ink composition is prepared so that adhesion to a recording medium using an ink jet method is possible. A condition for the ink composition to be applied to ink jet method is, for example, viscosity, and the viscosity of the ink composition at 20° C. is preferably 2 to 10 mPa·s and is more preferably 3 to 5 mPa·s. When the viscosity of the ink composition at 20° C. is in this range, since it is possible for the ink composition to be appropriately discharged from the nozzle and the curving when travelling and spattering of the ink composition to be reduced, the ink composition is more appropriate for application to the recording method of the embodiment. The viscosity of the ink composition is able to be appropriately adjusted by changing the arrangement, the types, and the composition ratios of the components described above.

1.1.5. Adhesive Composition

As the adhesive composition which is adhered using an ink jet method to the ink composition adhered to the recording medium 10, it is possible for the following to be exemplified. The adhesive composition includes at least an adhesive compound.

1.1.5.1. Adhesive Compound

As the adhesive compound which is included in the adhesive composition, it is possible to exemplify a monomer, an oligomer, and a polymer which are commonly used as an adhesion agent with an acrylic base, a urethane base, a vinyl chloride base, a vinyl acetate base, or the like, and it is possible to exemplify a vinyl-based resin such as a polyester-based resin, a polyacrylate ester-based resin, a polyvinyl acetate-based resin, a polyvinyl chloride-based resin, and a polyvinyl alcohol resin, a polyvinyl acetal-based resin such as polyvinyl acetoacetal and polyvinyl butyral, a polyether-based resin, a polyurethane-based resin, a styrene acrylate-based resin, a polyacrylamide-based resin, a polyamide-based resin, a polystyrene-based resin, a polyethylene-based resin, a polypropylene-based resin, a polyvinyl pyrrolidone-based resin, or a variant thereof. In addition, the adhesive compound may be a substance which has viscosity such as a natural resin such as rosin, gelatinized starch, glue, and various types of sugars or a variant thereof.

As further specific examples of the adhesive compound, examples include a vinyl chloride-based emulsion (Tg=−2° C.), a vinyl chloride-based emulsion (Tg=42° C.) (for example, vinyl chloride-based adhesive which is available from Nissin Chemical Industry Co., Ltd.), Mowinyl Powder 727 (Tg=5° C.), Mowinyl Powder 718A (Tg=−6° C.), Mowinyl Powder 752 (Tg=15° C.), Mowinyl Powder 7525 (Tg=−16° C.), Mowinyl Powder 745 (Tg=21° C.) (for example, an acrylic-based adhesive which is available from Nippon Synthetic Chemical Industry Co., Ltd.), Superflex 840 (Tg=5° C.), Superflex 500M (Tg=−39° C.) (for example, urethane-based adhesive which is available from Dai-ichi Kogyo Seiyaku Co., Ltd.).

Here, in a case where an emulsion is adopted as the adhesive compound, the emulsion may be obtained by synthesizing and the emulsion is able to be obtained using the polymerization of a monomer of a resin using, for example, a method of emulsion polymerization, suspension polymerization, or the like.

Due to the point of it being easy to configure a device where it is possible to make operation easy in the heating process in the recording method of the embodiment and the like, the glass transition point (Tg) of the adhesive compound is preferably −10° C. or more and 100° C. or less and is more preferably −10° C. or more and 70° C. or less.

The adhesive composition is able to exhibit adhesiveness due to heating by containing the substance described above. In addition, a compound which exhibits adhesiveness due to a reaction may be adopted in the adhesive composition and an additive such as a polymerization initiator, a reaction auxiliary, an antioxidant, a ultraviolet absorber, and a filler may be contained as necessary. Furthermore, an adhesive agent which is pressure sensitive which exhibits adhesiveness due to the application of pressure may be contained in the adhesive composition. As the adhesive agent which is pressure sensitive, examples include a substance which has a structure where an adhesive agent is inserted into small capsules. The adhesive composition may be a mixture of two or more types of substances which are exemplified above.

1.1.5.2. Characteristics of Adhesive Composition

The adhesive composition is prepared so that adhesion to a recording medium using an ink jet method is possible. A condition for the adhesive composition to be applied to ink jet method is, for example, viscosity, and the viscosity of the adhesive composition at 20° C. is preferably 2 to 10 mPa·s and is more preferably 3 to 5 mPa·s. When the viscosity of the adhesive composition at 20° C. is in this range, since it is possible for the adhesive composition to be appropriately discharged from the nozzle and the curving when travelling and spattering of the adhesive composition to be further reduced, the adhesive composition is more appropriate for application to the recording method of the embodiment.

In order to adjust the viscosity, the adhesive composition is able to contain, for example, a surfactant, a multivalent alcohol, an organic solvent, and a resin component. In addition, the adhesive composition may be water-based or may be solvent-based (non-water based).

In relation to a surfactant, a multivalent alcohol, an organic solvent, a resin component, and water which may be contained in the adhesive composition, the description thereof is not included since the description is the same as was described in the section above on the ink composition.

The viscosity of the adhesive composition is able to be appropriately adjusted by changing the arrangement, the types, and the composition ratios of the components therein.

The adhesive composition is able to exhibit adhesiveness after being adhered to the ink composition. In addition, the adhesive force (bonding force) between the surface where the adhesive composition is formed and the glitter film of the sheet where the glitter film which will be described later is formed is set to be larger than the adhesive force (bonding force) between the glitter film on the sheet where the glitter film is formed and the sheet.

1.1.6. Sheet where Glitter Film is Formed

The sheet where the glitter sheet is formed is able to be exemplified by the forming of a film which has glossiness formed from one type or two or more types selected from a group formed from, for example, aluminum, silver, gold, platinum, nickel, chromium, tin, zinc, indium, titanium, and copper on a surface of a plastic film (sheet) such as a film formed from, for example, a substance such as polyethylene terephthalate (PET), polybutylene terephthalate (PBT), polycarbonate, polyethylene naphthalate, polyester, polyethylene, polypropylene, acrylic resins, polystyrene, polyvinyl chloride, polyvinyl acetate, polyvinyl alcohol, polyether ether ketone, polyamide, polyether sulfone, polydiacetate, triacetate, and polyimide.

Such a sheet where the glitter film is formed is able to be obtained by forming a metal film using depositing, sputtering, or the like, on the surface of the sheet. In addition, a commercially available product may be used as such a sheet where the glitter film is formed. Furthermore, the sheet where the glitter film is formed may be surface (interface) treated so that the glitter film is easy to peel off from the sheet and may have a layer where peeling off is made easy.

1.2 Method for Recording Glitter Image

The method for recording a glitter image according to the embodiment includes a process for attaching the ink composition to the recording medium 10 using an ink jet method, a process for attaching the adhesive composition to the ink composition which is attached to the recording medium 10 using an ink jet method, a process for bringing a sheet 40 where a glitter film 42 is formed into contact with the recording medium 10 so that a surface where the adhesive composition is attached and a surface where the glitter film 42 is formed are opposed, a process for heating the adhesive composition, and a process for peeling off the recording medium 10 and the sheet 40.

Figure 5:
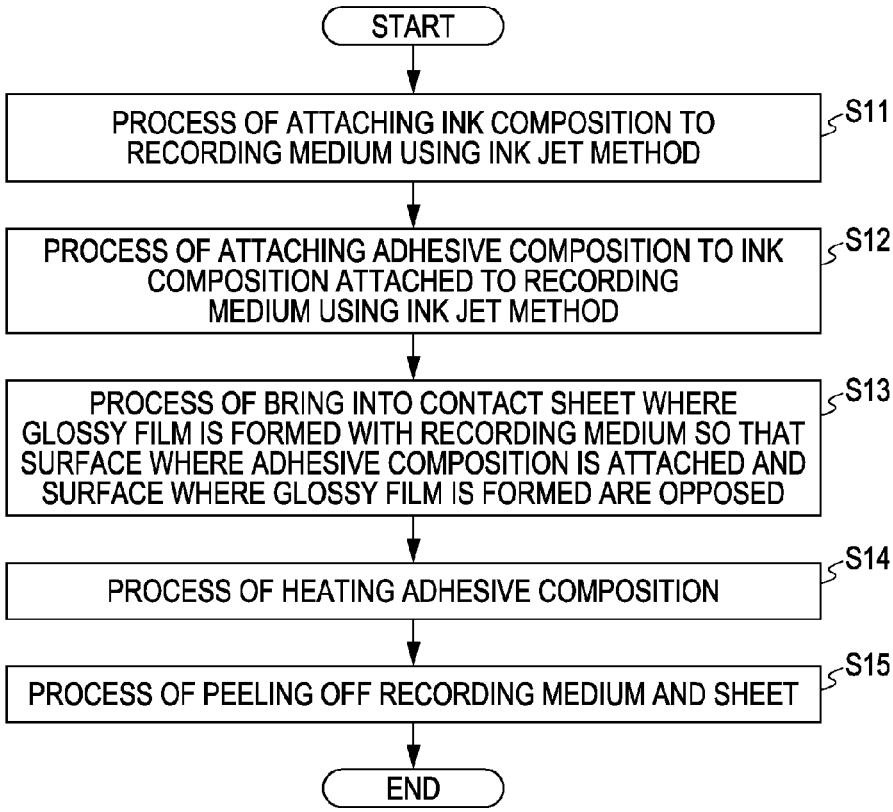
FIG. 5 is a flowchart illustrating an example of a recording method of an embodiment.
Figure 6:
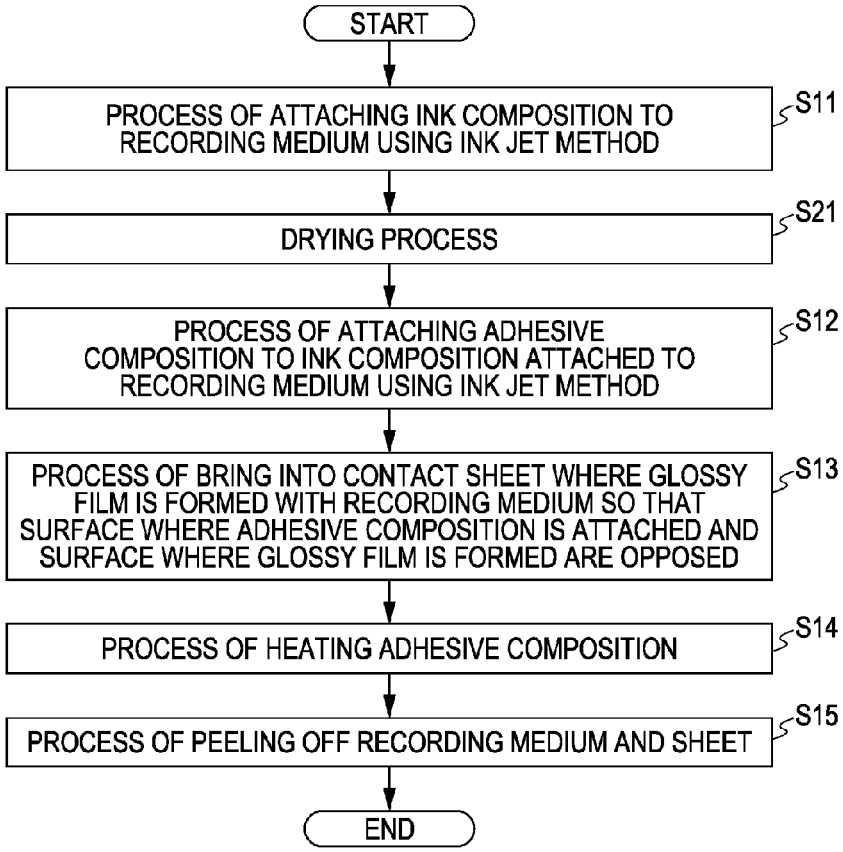
FIG. 6 is a flowchart illustrating an example of a recording method of an embodiment.

FIGS. 1 to 4 are schematic diagrams of processes of a recording method of glitter images according to the embodiment. FIGS. 5 and 6 are flowcharts illustrating an example of a recording method of glitter images according to the embodiment.

1.2.1. Process for Attaching Ink Composition

The method for recording a glitter image of the embodiment includes a process for attaching the ink composition to the recording medium 10 using an ink jet method (FIG. 5: step S11).

As shown in FIG. 1, an ink layer 20 is formed on the surface of the recording medium 10 due to this process. The thickness of the ink layer 20 is able to be, for example, 50 nm or more and 5 μm or less. The planar size (area) and shape of the ink layer 20 is not particularly limited. The ink layer 20 may be formed over the entire surface of the recording medium 10 or may be formed over a portion of the surface of the recording medium 10.

As one function of the ink layer 20, it is possible to exemplify bonding of an adhesive layer 30 and the glitter film 42 with regard to the recording medium 10. In addition, in a case where a colorant is contained in the ink composition, as one function of the ink layer 20, it is possible to exemplify the adjusting of the coloring of the glitter image which is obtained. Furthermore, in a case where the recording medium 10 has ink absorbability and the ink composition contains a pigment, as one function of the ink layer 20, it is possible to exemplify closing off of holes in the surface of the recording medium 10 and suppressing of the penetration of the adhesive composition to the inner portion of the recording medium 10.

In addition, the function of the ink layer 20 in the bonding the adhesive layer 30 and the glitter film 42 with regard to the recording medium 10 is remarkable in a case where the recording medium 10 does not have ink absorbability in practice.

Furthermore, the function of the ink layer 20 in the closing off of holes in the surface of the recording medium 10 and suppressing of the penetration of the adhesive composition to the inner portion of the recording medium 10 is remarkable in a case where the ink composition contains a white pigment, and furthermore, is even more remarkable when the volume-based average particle diameter of the white pigment is 300 nm.

1.2.2. Process for Adhering Adhesive Composition

The method for recording a glitter image of the embodiment includes a process for attaching the adhesive composition to the ink layer 20 using an ink jet method (FIG. 5: step S12).

Figure 2:
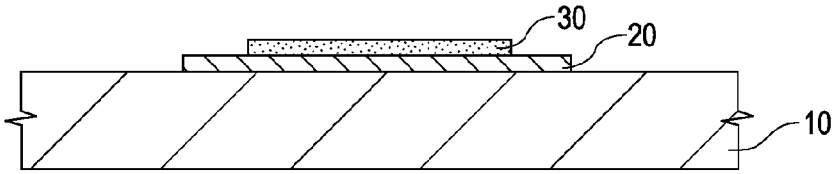
FIG. 2 is a schematic diagram of a process of a recording method of an embodiment.

As shown in FIG. 2, an adhesive layer 30 is formed due to this process on the ink layer 20 which is formed on the surface of the recording medium 10. The thickness of the adhesive layer 30 is able to be, for example, 50 nm or more and 5 μm or less. The planar size (area) and shape of the adhesive layer 30 is not particularly limited. The adhesive layer 30 may be formed over the entire surface of the ink layer 20 or may be formed over a portion of the surface of the ink layer 20.

As one function of the adhesive layer 30, it is possible to exemplify adhering of the glitter film 42 with regard to the ink layer 20.

Here, the adhesiveness of the adhesive layer 30 is a property where the ink layer 20 and the glitter film 42 are adhered. The adhesiveness may be exhibited in the same state as when the adhesive layer 30 is formed or may be exhibited when at least one type of stimulus such as, for example, temperature (heat), pressure, and irradiation (light and the like) is applied to the adhesive layer 30.

As one function of the adhesive layer 30, it is possible to exemplify transferring of the glitter film 42 to the side of the recording medium 10 which is a transfer destination by the glitter film 42 being peeled off from the sheet 40 where the glitter film 42 is formed.

1.2.3. Process for Bring Recording Medium and Sheet into Contact

The method for recording a glitter image of the embodiment includes a process for bringing the sheet 40 where the glitter film 42 is formed into contact with the recording medium 10 so that a surface where the adhesive composition is attached and the surface where the glitter film 42 is formed are opposed (FIG. 5: step S13).

Figure 3:
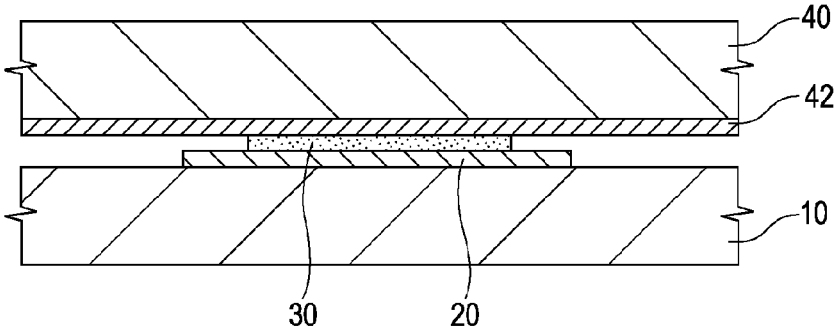
FIG. 3 is a schematic diagram of a process of a recording method of an embodiment.

As shown in FIG. 3, the glitter film 42 which is formed on the sheet 40 is brought into contact with the adhesive layer 30 which is formed on the recording medium 10 due to this process. In this process, only the adhesive layer 30 and the glitter film 42 come into contact in the example shown in the diagram, but the glitter film 42 may come into contact with the ink layer 20 and the recording medium 10. The format of the adhesive layer 30 and the glitter film 42 coming into contact is not particularly limited and the sheet 40 and the recording medium 10 may just be overlapped or may be pressed using a press or a roller. In addition, in a case where adhesiveness is exhibited by the adhesive composition receiving pressure, it is preferable to carry out a format of the pressing in this process, and in this case, it is possible to perform by applying the necessary pressure.

This process is appropriately performed according to the materials and the like in the adhesive layer 30. For example, in a case where the adhesive layer 30 has sufficient adhesiveness at a room temperature, it is possible to only perform the application of slight pressure by the recording medium 10 being placed with regard to the sheet 40. As necessary, a pressing process, roller pressing, and the like may be performed.

In addition, in a case where the adhesive layer 30 has a substance which exhibits adhesiveness due to heating, this process may be performed by at least one of the recording medium 10 and the sheet 40 being heated using an appropriate heating unit. In a case where this process is performed by at least one of the recording medium 10 and the sheet 40 being heated, it is possible to be combined with "1.2.4. Process for Heating Adhesive Composition". Furthermore, in a case where the adhesive layer 30 exhibits adhesiveness due to pressure, for example, it is possible for this process to be performed by a pressure being applied using roller pressing, a processing process, a jig, or the like.

1.2.4. Process for Heating Adhesive Composition

The method for recording a glitter image of the embodiment includes a process for heating the adhesive composition (FIG. 5: step S14). The adhesive layer 30 is formed using the adhesive composition due to the "1.2.2. Process for Adhering Adhesive Composition". This process is able to be performed as necessary. For example, this process is performed in a case where the adhesive composition contains an adhesive compound which has a substance which exhibits adhesiveness due to heating.

This process is able to be performed using a method such as, for example, warm air, a heating wire, an infrared heater, electromagnetic heating, or the like. Furthermore, this process may be performed so that the timing matches with the "1.2.3. Process for Bring Recording Medium and Sheet into Contact" or may be performed after the process for bringing the recording medium and the sheet into contact. That is, for example, it is possible to perform this process by the press or the roller being heated in a case of pressing or rolling and by being performed using the press or the roller in the process for bringing the recording medium and the sheet into contact. In addition, this process may be performed using a separate heating device after the process for bringing the recording medium and the sheet into contact.

Due to the heating in this process, the temperature which the adhesive layer 30 (the adhesive composition) reaches is not particularly limited. However, in a case where the adhesive composition is a type where adhesiveness is exhibited using phase transition between a glass state and a rubber state, it is preferable to heat to a temperature which is higher than the glass transition point (Tg). In addition, in a case where the adhesive composition is a type where adhesiveness is exhibited using a reaction (for example, a curing reaction), it is preferable to heat to a temperature which is higher than the reaction temperature.

In addition, in a case where the adhesive layer 30 contains a polymer with thermo-plasticity, it is preferable that the adhesive layer 30 be heated to a temperature which is higher than at least the Tg (glass transition temperature) and the Tm (melting point) of the polymer with thermo-plasticity in this process.

Due to this process, the adhesive layer 30 and the glitter film 42 are adhered. Here, the adhesive layer 30 is also adhered to the ink layer 20, and furthermore, the ink layer 20 is bonded to the recording medium 10. Accordingly, by passing through this process, a laminate body of the recording medium 10, the ink layer 20, the adhesive layer 30, the glitter film 42, and the sheet 40 is formed. Then, the adhesive force between the adhesive layer 30 and the glitter film 42 is set to be at least larger than the adhesive force between the glitter film 42 and the sheet 40 which is provided in the next process.

1.2.5. Process for Peeling Off Recording Medium and Sheet

The method for recording a glitter image of the embodiment includes a process for peeling off the recording medium 10 and the sheet 40 (FIG. 5: step S15).

Figure 4:
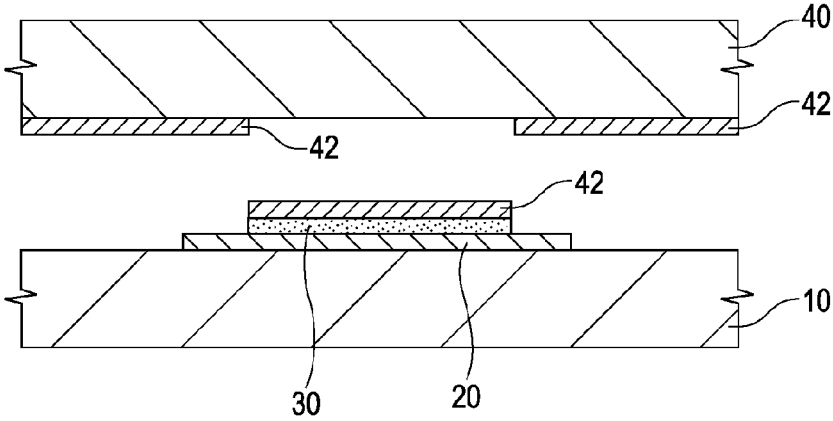
FIG. 4 is a schematic diagram of a process of a recording method of an embodiment.

As shown in FIG. 4, the glitter film 42 is transferred to the recording medium 10 side from the sheet 40 due to this process. A portion of the glitter film 42 which is adhered to the adhesive layer 30 is transferred. In the example in the diagram, only the portion of the glitter film 42 which is in direct contact with the adhesive layer 30 is transferred but the portion of the glitter film 42 which is transferred may have an area which is larger than the adhesive layer 30. It is possible to adjust such a format using, for example, the thickness of the glitter film 42, the adhesive force between the glitter film 42 and the sheet 40, the adhesive force between the adhesive layer 30 and the glitter film 42, the format where the recording medium 10 and the sheet 40 come into contact, the angle of peeling in this process, and the like.

This process is able to be performed using a typical peeler or the like. In addition, this process is able to be appropriately performed along with the transportation of the sheet 40 and the recording medium 10 by being appropriately placed on a roller or the like. Furthermore, this process may be performed manually by the user.

In a case where the adhesive layer 30 includes a compound with thermo-plasticity, it is preferable that this process be performed while the adhesive layer 30 is being cooled after the "heating process". In such a case, for example, it is possible to provide a cooling process after the heating process. As the cooling process, for example, examples include providing a cooling period or cooling the adhesive layer 30 using a cooling unit (cooling roller or the like).

1.2.6. Drying Process

The method for recording a glitter image of the embodiment may include a drying process (FIG. 6: step S21). The drying process is performed as necessary.

The drying process is able to be performed between the "Process for Attaching Ink Composition (step S11)" and the "Process for Attaching Adhesive Composition (step S12)". The drying process is a process where drying of the ink composition (the ink layer 20) which is attached to the recording medium 10 is performed. The drying processing is able to be performed using, for example, warm air, a heating wire, an infrared heater, electromagnetic heating, or the like.

In the drying process, water, solvents, and the like in the ink composition are removed. That is, the drying process is able to remove components such as water and solvents from the ink composition immediately after being attached to the recording medium 10 (immediately after being discharged from the nozzle of the ink jet).

When the drying process is performed, it is possible to suppress the adhesive composition mixing with the solvents and the like which remain in the ink layer 20 when the adhesive composition is attached after the forming of the ink layer 20. Due to this, there are cases where it is easy for the adhesive compound to be concentrated on the surface and there are cases where it is possible to further increase the adhesiveness of the adhesive layer 30 and the glitter film 42.

The degree of drying in the drying process is a degree where the mass of the ink composition immediately after being attached to the recording medium 10 (immediately after being discharged from the nozzle of the ink jet) is reduced by, for example, 10% or more and 99% or less and is preferably a degree of being reduced by 40% or more and 95% or less.

The recording method of the embodiment is a case where it is possible to form an image with further excellence in bonding with regard to the recording medium 10 in a case where the drying process is included.

1.2.7. Operational Effects

The recording method of the embodiment is able to easily form an image with excellent glossiness and bonding with regard to the recording medium by the processes above being performed.

2. Recording Apparatus

Figure 7:
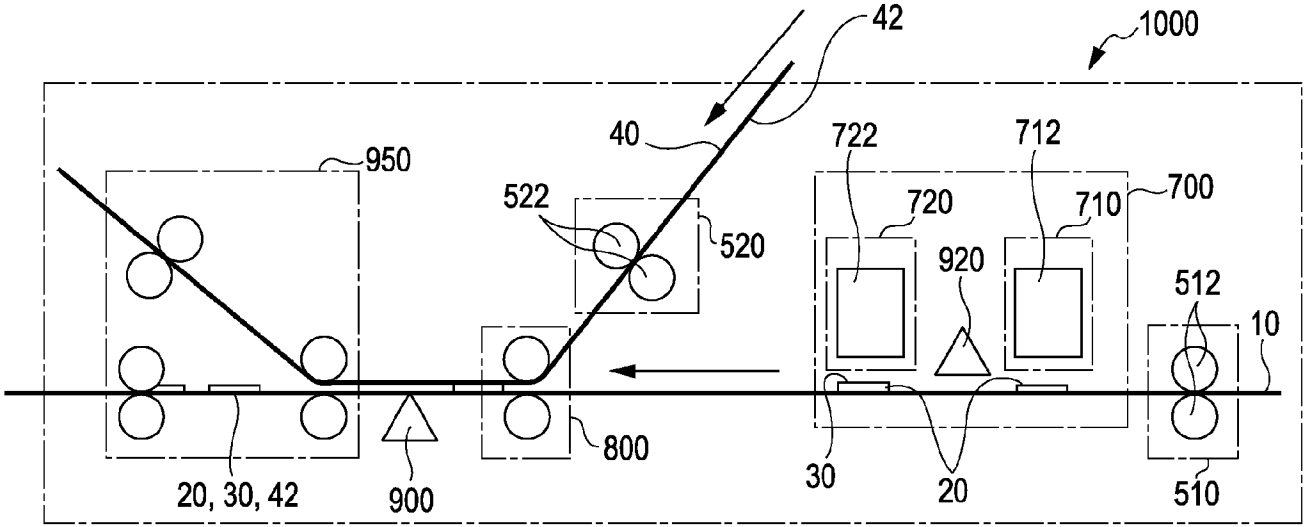
FIG. 7 is a schematic diagram illustrating an example of a recording apparatus of an embodiment.

Below, an example of the recording apparatus which is able to be appropriately applied to the recording method described above is exemplified. FIG. 7 is a schematic diagram illustrating an example of a recording apparatus which is used in the method for recording a glitter image according to the embodiment.

A recording apparatus 1000 of the embodiment is provided with a first transport unit 510 which transports the recording medium 10, a second transport unit 520 which transports the sheet 40 where the glitter film 42 is formed, a first recording unit 710 which records an image using the ink composition, a second recording unit 720 which records an image using the adhesive composition, a contacting unit 800, a heating unit 900, and a peeling unit 950.

2.1. First Transport Unit and Second Transport Unit

The first transport unit 510 transports the recording medium 10. The second transport unit 520 transports the sheet 40 where the glitter film 42 is formed.

The first transport unit 510 is able to be configured using, for example, a roller 512. The first transport unit 510 may have a plurality of rollers 512. The first transport roller 510 is provided more to the upstream side than the first recording unit 710 in a direction in which the recording medium 10 is transported (shown by the arrow in the diagram) in the example of the diagram, but is not limited thereto and the position where provided and the number thereof are arbitrary as long as the recording medium 10 is able to be transported.

The second transport unit 520 is able to be configured using, for example, a roller 522. The second transport unit 520 may have a plurality of rollers 522. The second transport unit 520 is provided more to the upstream side than the second recording unit 720 in a direction in which the sheet 40 is transported in the example of the diagram, but is not limited thereto and the position where provided and the number thereof are arbitrary as long as there is an arrangement where it is possible for the sheet 40 where the glitter film 42 is formed to be laminated with regard to the recording medium 10.

The first transport unit 510 and the second transport unit 520 may be respectively provided with a paper feeding roll, a paper feeding tray, a paper discharge roll, a paper discharge tray, various types of platens, and the like and are configured so that it is possible for the recording medium 10 and the sheet 40 where the glitter film 42 is formed to be laminated.

The recording medium 10 which is transported by the first transport unit 510 is transported to a position where the ink composition and the adhesive composition are attached using the first recording unit 710 and the second recording unit 720. In addition, the sheet 40 where the glitter film 42 is formed is transported by the second transport unit 520 to a position where it is possible for the recording medium 10 and the sheet 40 where the glitter film 42 is formed to come into contact using the contacting unit 800.

Here, in FIG. 7, a case is exemplified where the recording medium 10 and the sheet 40 where the glitter film 42 is formed are both continuous bodies, but even if at least one of the recording medium 10 and the sheet 40 where the glitter film 42 is formed are single sheets, it is possible to perform transporting of the recording medium as described above using an appropriate configuration of the first transport unit 510 and the second transport unit 520.

The first recording unit 710 records an image (the ink layer 20) using the ink composition with regard to the recording medium 10. The second recording unit 720 records an image (the adhesive layer 30) using the adhesive composition with regard to the recording medium 10. The first recording unit 710 and the second recording unit 720 may be configured to have separate recording heads 712 and 722 or to have an integrated recording head 700.

2.2. Contacting Unit, Heating Unit, and Peeling Unit

The contacting unit 800 brings the recording medium 10 and the sheet 40 where the glitter film 42 is formed into contact. As the configuration of the contacting unit 800, for example, it is possible to exemplify, for example, a pressure roller.

The heating unit 900 is provided more to the downstream side than the contacting unit 800 in the direction in which the recording medium 10 is transported (shown by the arrow in the diagram). The heating unit 900 is able to be configured using, for example, a heating roller. In addition, as pressurizing unit which has a heating mechanism, for example, examples include a configuration with the main portions of a typical laminator apparatus. Furthermore, it is preferable that the heating unit 900 be provided at a position which is the same as the contacting unit 800 or more to the downstream side than the contacting unit 800 in the direction in which the recording medium 10 is transported. For example, by providing the heating mechanism in the contacting unit 800, it is possible to have the heating mechanism as the heating unit 900.

The recording medium 10 and the sheet 40 where the glitter film 42 is formed are separated after this using the peeling unit 950. The peeling unit 950 is able to adopt a common peeling unit, and for example, there is platform separation where an inclination is provided and retard roller separation where friction is used. Due to the peeling unit 950, as shown in the diagram, a glitter image where the ink layer 20, the adhesive layer 30, and the glitter film 42 are laminated is formed on the recording medium 10.

In addition, the recording apparatus 1000 may be provided with a drying unit 920 between the first recording unit 710 and the second recording unit 720. In a case where the drying unit 920 is provided, it is preferable that the first recording unit 710 and the second recording unit 720 have separate recording heads 712 and 722. As the drying unit 920, it is possible to adopt a common drying unit.

The recording apparatus 1000 of the embodiment which is configured as described above is appropriate for the method for recording a glitter image of the embodiment.

3. Experiment Example

Below, several experiment examples are shown and the invention is described in detail, but the range of the invention is not limited to this.

3.1. Ink Composition

As the ink composition, clear ink, yellow ink, magenta ink, and white ink are prepared. Each of the inks is manufactured as per below.

ink was obtained by adding solvents as described in Table 1 so that the yellow pigment has the content as in Table 1.

Using the same method, clear ink, magenta ink, and white ink were obtained by being respectively changed to an ink which does not contain a pigment, an ink which contains a magenta pigment (pigment red 122 (PR122)), and an ink which uses a white pigment (titanium dioxide). The composition of each of the inks is shown in Table 1. In addition, the white ink is manufactured into each of a white ink 1 and a white ink 2 using two types of titanium dioxide where the volume-based average particle diameter was 280 nm and 330 nm as the white pigment. Here, the styrene-acrylate copolymer uses JONCRYL 7100 (manufactured by BASF).

TABLE 1

| | | Ink Composition (mass %) | | | | | Adhesive Composition | | |
|---|---|---|---|---|---|---|---|---|---|
| | | Clear | Yellow | Magenta | White 1 | White 2 | 1 | 2 | 3 |
| Pigment | PY155 | — | 4 | — | — | — | — | — | — |
| | PR122 | — | — | 4 | — | — | — | — | — |
| | Titanium dioxide | — | — | — | 10 | 10 | — | — | — |
| | Average particle diameter of pigment (nm) | — | 190 | 100 | 280 | 330 | — | — | — |
| Adhesive Compound | Mowinyl Powder 727 (Tg = 5° C.) Acrylic-based | — | — | — | — | — | 10 | — | — |
| | Superflex 840 (Tg = 5° C.) urethane- based | — | — | — | — | — | — | 10 | — |
| | Vinyl chloride-based emulsion (Tg = −2° C.) | — | — | — | — | — | — | — | 10 |
| Surfynol DF110D | | 1 | 1 | 1 | 1 | 1 | 1 | 1 | 1 |
| propylene glycol | | 12 | 8 | 8 | 8 | 8 | 11 | 11 | 11 |
| 1,2-hexanediol | | 5 | 5 | 5 | 5 | 5 | 5 | 5 | 5 |
| 2-Pyrrolidone | | 2 | 2 | 2 | 2 | 2 | 2 | 2 | 2 |
| Styrene-acrylate copolymer | | 7 | 3 | 3 | 3 | 3 | — | — | — |
| Ion-exchange water | | Residual | Residual | Residual | Residual | Residual | Residual | Residual | Residual |

The yellow ink was prepared as per below. Into a mixed solution of 7 parts of potassium hydroxide, 23 parts of water, and 30 parts of triethylene glycol-mono-n-butyl ether, 40 parts of polymer dispersing agent (copolymerization of methacrylic acid/butyl acrylate/styrene/hydroxyethyl acrylate with a molar ratio of 25/50/15/10. Weight average particle amount of 12,000) was inserted, a polymerization reaction was performed by heating at 80° C. and stirring, and a polymer dispersing agent varnish was manufactured. To 2.4 kg of the varnish (solid content of 43%), 3.0 kg of yellow pigment (pigment yellow 155 (PY155)), 1.5 kg of ethylene glycol, and 8.1 kg of water were mixed, and premixing was performed by stirring using a mixture stirring unit. Dispersion of a pigment dispersion solution was performed using a multi-pass method with a horizontal type of beads mill which is provided with a multi-disk type impeller with an effective volume of 1.5 liters where 85% thereof is filled with 0.5 mm zirconia beads. Specifically, two passes were performed with a discharge amount of 30 liters in one hour with a beads speed of 8 m/sec and a pigment dispersion mixture solution was obtained. Next, circulation dispersion was performed with a horizontal annular type of beads mill with an effective volume of 1.5 liters where 95% thereof is filled with 0.5 mm zirconia beads. A screen of 0.015 mm was used and a dispersion process was performed for four hours with 10 kg of the pigment dispersion mixture solution having a circulation amount of 300 liters with a beads circulation speed of 10 m/sec and a yellow pigment dispersion solution was obtained. After this, a yellow

3.2. Adhesive Composition

Three types of adhesive compositions were obtained by sufficiently mixing each of the components shown in Table 1 in the arrangement amounts shown in Table 1.

3.3. Recording Medium and Sheet where Glitter Film is Formed

As the recording medium, a polyethylene terephthalate film (PET50A (manufactured by Lintec Corporation)) and Matt Superfine paper (manufactured by Seiko Epson Corporation) were used. The sheet where the glitter film is formed uses a silicon based separating agent and uses the depositing of aluminum.

3.4. Recording Apparatus

The ink composition and the adhesive composition were filled into ink tanks of an ink jet printer with a model type of PX-G5500 which is manufactured by Seiko Epson Corporation and test pattern printing was performed in an amount of 45 mg/inch respectively in the order of the ink composition and the adhesive composition with regard to each of the recording media. In any of the cases, there was printing so that the adhesive composition is attached on the ink composition. Then, the surface where the glitter film is formed on the sheet is faced and matched with regard to the printing surface and was passed through a laminator apparatus which is commercially available. Here, when transferring, a JOL-DIGITAL-4JOL0 (manufactured by Japan Office Laminator Co., Ltd.) was used, and the temperature of the heat pressurizing roller was set at 130° C., the pressure was set at 30 kg/cm$^2$, and the speed was set at 20 cm/sec.

After this, evaluations of the glitter images were provided by the experimenter manually peeling off.

The ink composition, the adhesive composition, the recording medium and the evaluation results which are used in each experiment example are shown in Table 2.

3.5. Evaluation of Image Transfer

Image transfer was evaluated according to the standard below and the evaluation results are described in Table 2.

A: The glitter images which are obtained are smooth and peeling irregularities are not visible.

B: Peeling irregularities are visible in an area which is 5% or less of the adhesive layer.

C: Peeling irregularities are visible in an area which exceeds 5% and is 20% or less of the adhesive layer.

D: Peeling irregularities are visible in an area which exceeds 20% of the adhesive layer.

3.6. Evaluation of Adhesiveness

In each of the experiment examples, a scratch resistance experiment was performed based on JIS K5701 using a Sutherland rough tester at a point in time where 48 hours has elapsed since the peeling off of the recording medium and the sheet, the glossiness was measured (blasting angle of 60°) with regard to the glitter image before and after the scratch resistance experiment, the rate of reduction in the glossiness before and after the scratch resistance experiment was determined and was set as the evaluation of the bonding. The evaluation standard is as per below and the evaluation results are described in Table 2. Here, "-" is written in the Table in the experiment example 8 since there were remarkable peeling irregularities and it was not possible to perform evaluation of the bonding.

A: Rate of reduction of glossiness is less than 10%

B: Rate of reduction of glossiness is 10% or more and less than 20%

C: Rate of reduction of glossiness is 20% or more

TABLE 2

| | | Experiment Example | | | | | | | | | |
|---|---|---|---|---|---|---|---|---|---|---|---|
| | | 1 | 2 | 3 | 4 | 5 | 6 | 7 | 8 | 9 | 10 |
| Type of Ink Composition | | White 2 | White 2 | Yellow | Clear | White 1 | White 2 | White 2 | Magenta | None | None |
| Average Particle Diameter of Pigment | | 330 nm | 330 nm | — | — | 280 nm | 330 nm | 330 nm | 100 nm | — | — |
| Type of Adhesive Composition | | 1 | 1 | 1 | 1 | 1 | 2 | 3 | 1 | 1 | 1 |
| Type of Recording Medium | | Mat | PET | PET | PET | Mat | PET | PET | Mat | Mat | PET |
| Evaluation Results | Image Transfer | B | A | A | A | B | A | A | C | D | C |
| | Adhesiveness | A | A | A | A | B | A | A | C | — | C |

3.7. Evaluation Results

Looking at Table 2, excellent result were shown for both image transfer and bonding in the experiment examples 1 to 8 where the ink composition is attached. In addition, if the volume-based average particle diameter of the pigment which is contained in the ink composition was larger than 100 nm, further excellence in the results was exhibited, and since there were particularly excellent results with 330 nm, it is estimated that particularly excellent results are exhibited when 280 nm is exceeded. In addition, even if the adhesive compound of the adhesive composition is changed, any of the evaluation results were excellent. Furthermore, even if the type of the recording medium is PET or Mat, excellent results were exhibited in the experiment examples 1 to 8 where the ink composition is attached.

From the above, according to the recording method of the invention, it is understood that it is possible to easily form an image with excellent glossiness and bonding with regard to the recording medium with a wide range of ink compositions, adhesive compositions, and recording mediums.

The invention is not limited to the embodiments described above and various modifications are possible. For example, the invention includes substantially the same configurations as the configurations which are described in the embodiments (for example, a configuration where the functions, the methods, and the results are the same and a configuration where the object and the effects are the same). In addition, the invention includes a configuration which exhibits the same operational effects as the configurations which are described in the embodiments and a configuration where it is possible to reach the same objective. In addition, the invention includes a configuration where common techniques are added to the configurations which are described in the embodiments.

What is claimed is:

1. A method for recording a glitter image comprising:

attaching an ink composition to a recording medium using an ink jet method;

attaching an adhesive composition to the ink composition which is attached to the recording medium using an ink jet method;

bringing a sheet where a glitter film is formed into contact with the recording medium so that a surface where the adhesive composition is attached and a surface where the glitter film is formed are opposed;

heating the adhesive composition; and peeling off the recording medium and the sheet, wherein the adhesive composition contains an adhesive compound, and the adhesive compound has a Tg which is −10° C. or more and 70° C. or less.

2. The method for recording a glitter image according to claim 1, wherein the recording medium has ink absorbability, and the ink composition contains a pigment.

3. The method for recording a glitter image according to claim 2, wherein the pigment is a white pigment.

4. The method for recording a glitter image according to claim 3, wherein the volume-based average particle diameter of the white pigment is 300 nm or more.

5. The method for recording a glitter image according to claim 1, wherein the recording medium does not have ink absorbability in practice, and the ink composition contains a white pigment.

6. The method for recording a glitter image according to claim 1, wherein the recording medium does not have ink absorbability in practice, and the ink composition does not contain a pigment.

7. The method for recording a glitter image according to claim 1, wherein the ink composition contains a resin of 3 mass % or more.

8. The method for recording a glitter image according to claim 1, further comprising:

drying between the attaching of the ink composition and the attaching of the adhesive composition, wherein the mass of the ink composition which is attached to the recording medium is reduced by 40% or more and 95% or less in the drying.

9. A method for recording a glitter image comprising:

attaching an ink composition to a recording medium using an ink jet method;

attaching an adhesive composition to the ink composition which is attached to the recording medium using an ink jet method;

bringing a sheet where a glitter film is formed into contact with the recording medium so that a surface where the adhesive composition is attached and a surface where the glitter film is formed are opposed;

heating the adhesive composition;

peeling off the recording medium and the sheet; and drying between the attaching of the ink composition and the attaching of the adhesive composition, wherein the mass of the ink composition which is attached to the recording medium is reduced by 40% or more and 95% or less in the drying.

10. The method for recording a glitter image according to claim 9, wherein the recording medium has ink absorbability, and the ink composition contains a pigment.

11. The method for recording a glitter image according to claim 10, wherein the pigment is a white pigment.

12. The method for recording a glitter image according to claim 11, wherein the volume-based average particle diameter of the white pigment is 300 nm or more.

13. The method for recording a glitter image according to claim 9, wherein the recording medium does not have ink absorbability in practice, and the ink composition contains a white pigment.

14. The method for recording a glitter image according to claim 9, wherein the recording medium does not have ink absorbability in practice, and the ink composition does not contain a pigment.

15. The method for recording a glitter image according to claim 9, wherein the ink composition contains a resin of 3 mass % or more.

16. The method for recording a glitter image according to claim 9, wherein the adhesive composition contains an adhesive compound, and the adhesive compound has a Tg which is −10° C. or more and 70° C. or less.

* * * * *